US006605209B2

(12) United States Patent
Lei et al.

(10) Patent No.: US 6,605,209 B2
(45) Date of Patent: Aug. 12, 2003

(54) NON-BIODEGRADABLE WASTE PYROLYSIS SYSTEM WITH SELECTIVE RESIDENCE-TIME REACTOR BY RECYCLE OF SELF-SUSTAINING HEAT-CONSERVATION MEDIUM

(75) Inventors: Cheng-En Lei, Hsintien (TW); Fu-Jung Huang, Hsintien (TW); Wen-Pin Wu, Hsintien (TW); Shyh-Shin Chen, Hsintien (TW); Joe Yueh Chou, Hsintien (TW)

(73) Assignee: Green Formosa Energy Technology Co., Ltd., Taipei Hsien (TW)

( * ) Notice: Subject to any disclaimer, the term of this patent is extended or adjusted under 35 U.S.C. 154(b) by 15 days.

(21) Appl. No.: 10/012,911

(22) Filed: Nov. 13, 2001

(65) Prior Publication Data

US 2003/0089646 A1 May 15, 2003

(51) Int. Cl.[7] ..... B29B 17/00; C08J 11/10

(52) U.S. Cl. ..... 210/86; 210/87; 210/90; 210/103; 210/104; 210/173; 210/181; 210/205; 210/260

(58) Field of Search ..... 210/86, 87, 90, 210/97, 103, 104, 175, 181, 182, 198.1, 205, 252, 257.1, 258, 259, 260, 359, 173; 585/240, 241

(56) References Cited

FOREIGN PATENT DOCUMENTS

| | | | |
|---|---|---|---|
| CN | 1114675 A | * | 1/1996 |
| CN | 1141331 A | * | 1/1997 |
| JP | 09-71785 | * | 3/1997 |
| TW | 295903 | * | 1/1997 |

* cited by examiner

*Primary Examiner*—Joseph Drodge
*Assistant Examiner*—Terry K. Cecil
(74) *Attorney, Agent, or Firm*—Thomas, Kayden, Horstemeyer & Risley LLP

(57) ABSTRACT

A self-sustaining non-biodegradable waste breakdown system has a preprocessing assembly, a heating assembly, a reaction assembly and a filtering assembly. The reaction assembly has a filtering layer to retain long chain molecules of the melted waste for continuous breakdown so as to change the long chain molecules into short chain molecules. The filtering-adjusting mechanism of the filtering assembly recycles the medium with a special concentration, viscosity and heat resistance in the reaction chamber.

1 Claim, 4 Drawing Sheets

NON-BIODEGRADABLE WASTE PYROLYSIS SYSTEM WITH SELECTIVE RESIDENCE-TIME REACTOR BY RECYCLE OF SELF-SUSTAINING HEAT-CONSERVATION MEDIUM

BACKGROUND OF THE INVENTION

1. Field of the Invention

The present invention relates to a self-sustaining, non-biodegradable waste breakdown system, and more particularly to a waste breakdown system having byproducts used as fuel for the system so the system provides its own power to maintain system operation and is environmentally be friendly.

2. Description of Related Art

For many years, people have been trying to find a way to stop the pollution caused by the non-biodegradable waste. Methods using electricity, coal and biochemistry have been employed in an attempt to solve the problem. However, none of these methods has successfully achieved the goal where the byproducts generated during the process are compatible with nature. Accordingly, there has not been much advancement in stopping the pollution caused by non-biodegradable waste.

Examples of attempts that have been less than fully successful include China Patent No. 2231683, China Patent No. 1141331, China Patent No. 1114675, China Patent No. 2189609, Taiwan Publication No. 286626 and Taiwan Publication No. 295903. China Patent No. 2231683 uses an electric heater and a burner as the heat source for breakdown and gasification of the waste. To achieve the predetermined goal, the equipment in the '683 patent consumes so much energy that the process is very costly. China Patent No. 1141331 uses aluminum and iron as catalyst to increase the speed of non-biodegradable waste breakdown, which uses too much expendable material and makes continuous operation difficult because of the necessity to replenish the catalyst. China Patent No. 1114675 adapts two phases to breakdown the non-biodegradable waste. Although the '675 patent does not use any kind of catalyst, the potential risk of explosion is very high due to the pressure increase in the second phase. China Publication No. 2189609 has a debris control device to ease the problem of blockage by the debris. However, continuous operation to breakdown the waste cannot be sustained. Taiwan Publication No. 286626 uses external a heating device to preheat the furnace so the non-biodegradable waste will disintegrate into flammable gases and light oil, but consumes a great deal of energy. Taiwan Publication No. 295903 deletes the pre-heating process and substitutes the use of a solvent to disintegrate the non-biodegradable waste to decrease the consumption of energy. However, this patent does not consider various differences in wastes and thus causes secondary pollution and blockage of the pipes.

To overcome the shortcomings, the present invention provide an improved self-sustaining non-biodegradable waste breakdown system to mitigate and obviate the aforementioned problems.

SUMMARY OF THE INVENTION

The primary objective of the present invention is to have a reactor with a filtering layer to absorb the long chain molecules of the disintegrated waste so that the long chain molecules stays on the filtering layer to continue the breakdown process and become short chain molecules. The short chain molecule is then condensed to an oil with high value.

Another objective of the present invention is that the heat is able to be fedback to continue the breakdown of the waste to decrease the cost and secondary pollution to the environment.

Other objects, advantages and novel features of the invention will become more apparent from the following detailed description when taken in conjunction with the accompanying drawings.

DETAILED DESCRIPTION OF THE PREFERRED EMBODIMENT

Figure 1:
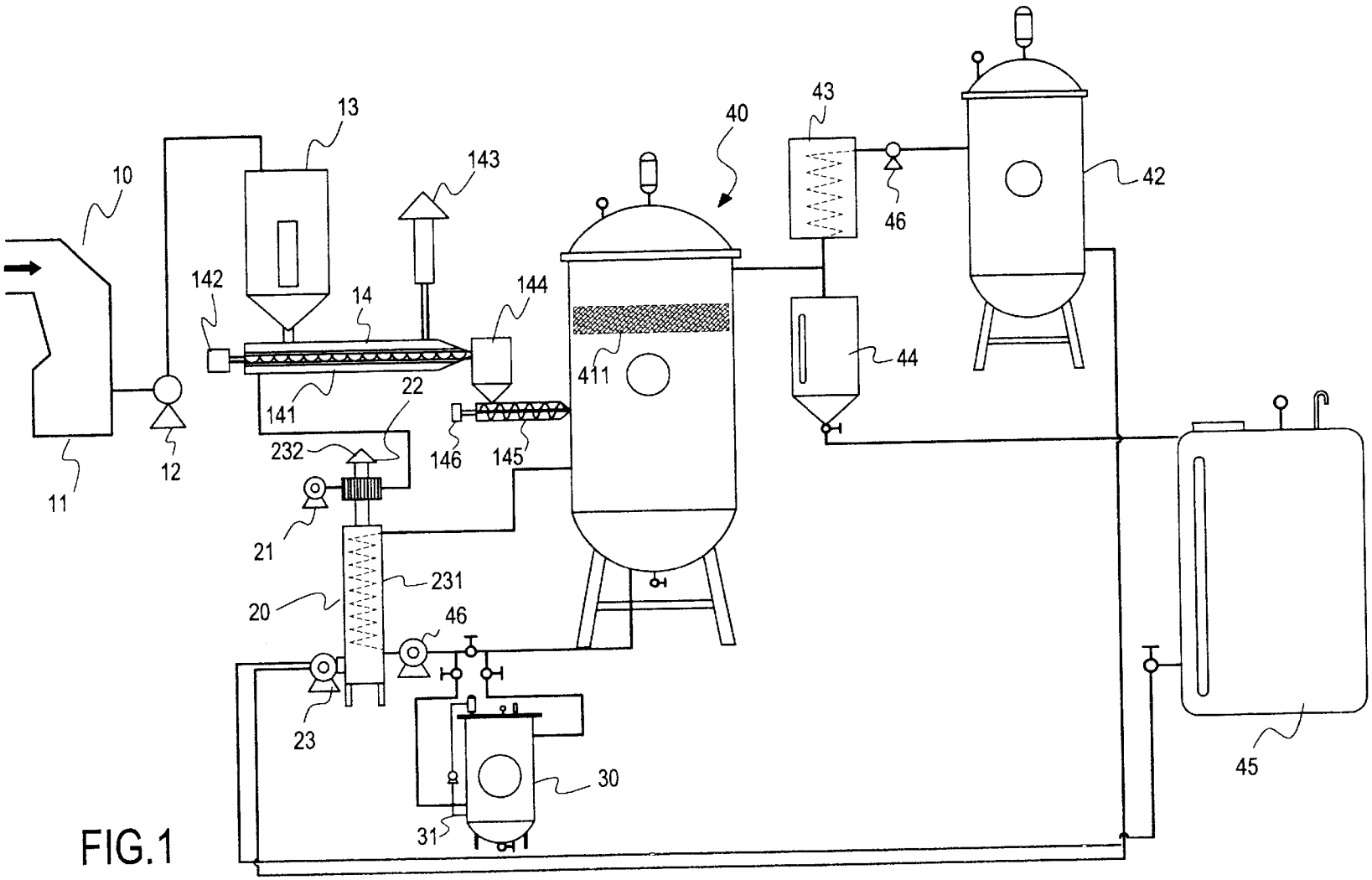
FIG. 1 is a schematic diagram of a waste breakdown system in accordance with the present invention.
Figure 2:
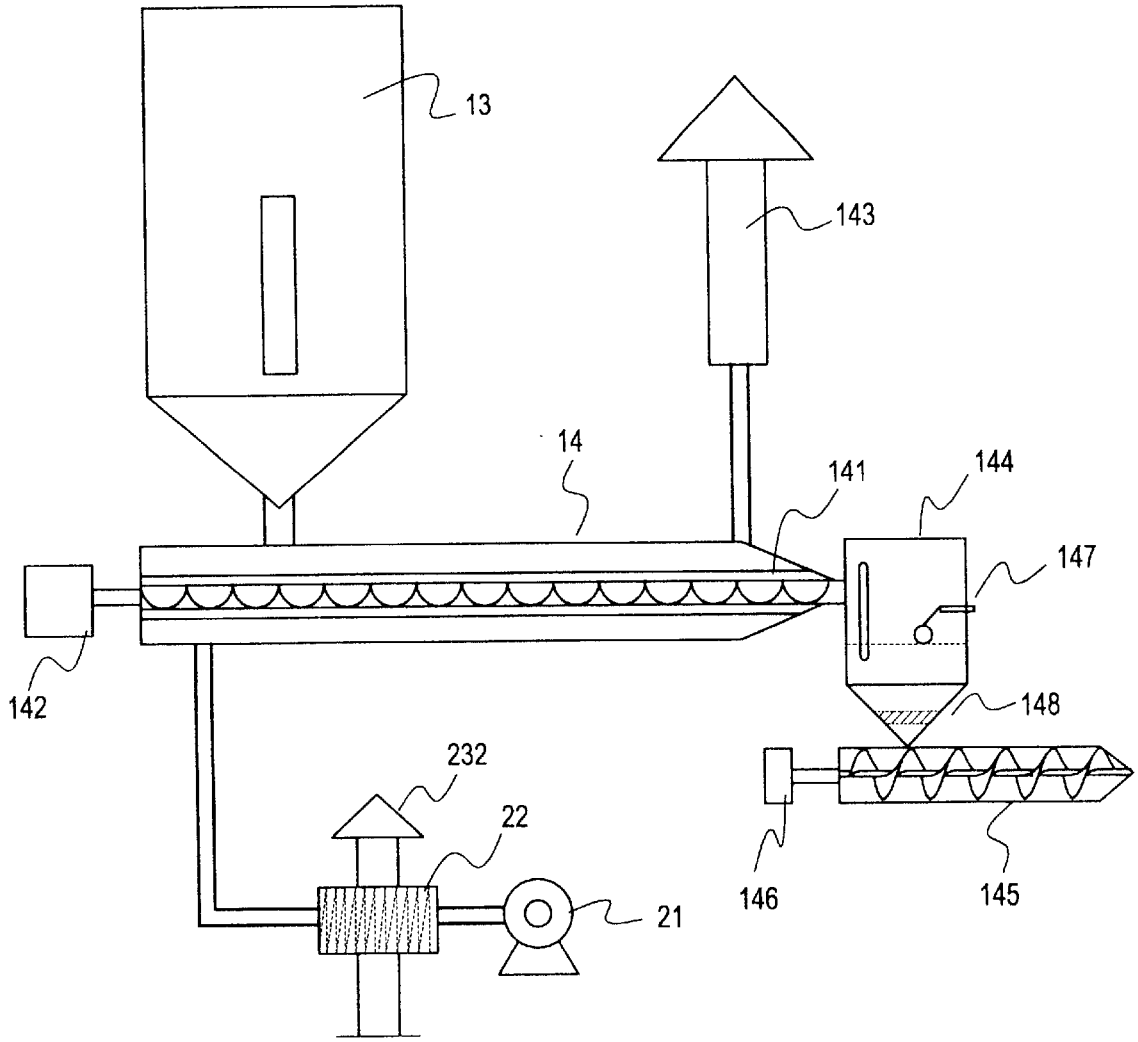
FIG. 2 is a schematic diagram of the heating assembly in the waste breakdown system in FIG. 1.

With reference to FIGS. 1 and 2, the self-sustaining non-biodegradable waste breakdown system in accordance with the present invention has a preprocessing assembly (10), a heating assembly (20), a filtering assembly (30) and a reaction assembly (40).

The preprocessing assembly (10) includes a grinder (11), a conveyer (12), a collector (13) and a heater (14). The grinder (11) grinds the non-biodegradable waste to be broken-down into pieces. The conveyer (12) transports the ground non-biodegradable waste to the collector (13). A first worm (141) inside the heater (14) and driven by a first motor (142) moves the non-biodegradable waste through the heater (14) where it is liquefied to a first tank (144) for temporary storage. A float sensor (147) inside the first tank (144) senses the level of the liquid, and a first filter (148) screens unwanted particles from the liquid. Then a second worm (145) driven by a second motor (146) sends the liquid to the reaction assembly (40) for breakdown. A ventilation duct (143) is connected to the heater (14) to allow heat to escape after melting the non-biodegradable waste.

Referring again to FIGS. 1 and 2, the heating assembly (20) has a furnace (231), a heat exchanger (22), a blower (21), and a burner (23). The heat exchanger (22) draws heat from the furnace (231). The blower (21) transfers heat (around 600° C.) from the heat exchanger (22) to the first worm (141) to heat the non-biodegradable waste. The heat of the furnace (231) the burner (23). Fuel for the burner (23) comes from a fuel tank (45) and a gas tank (42).

Figure 3:
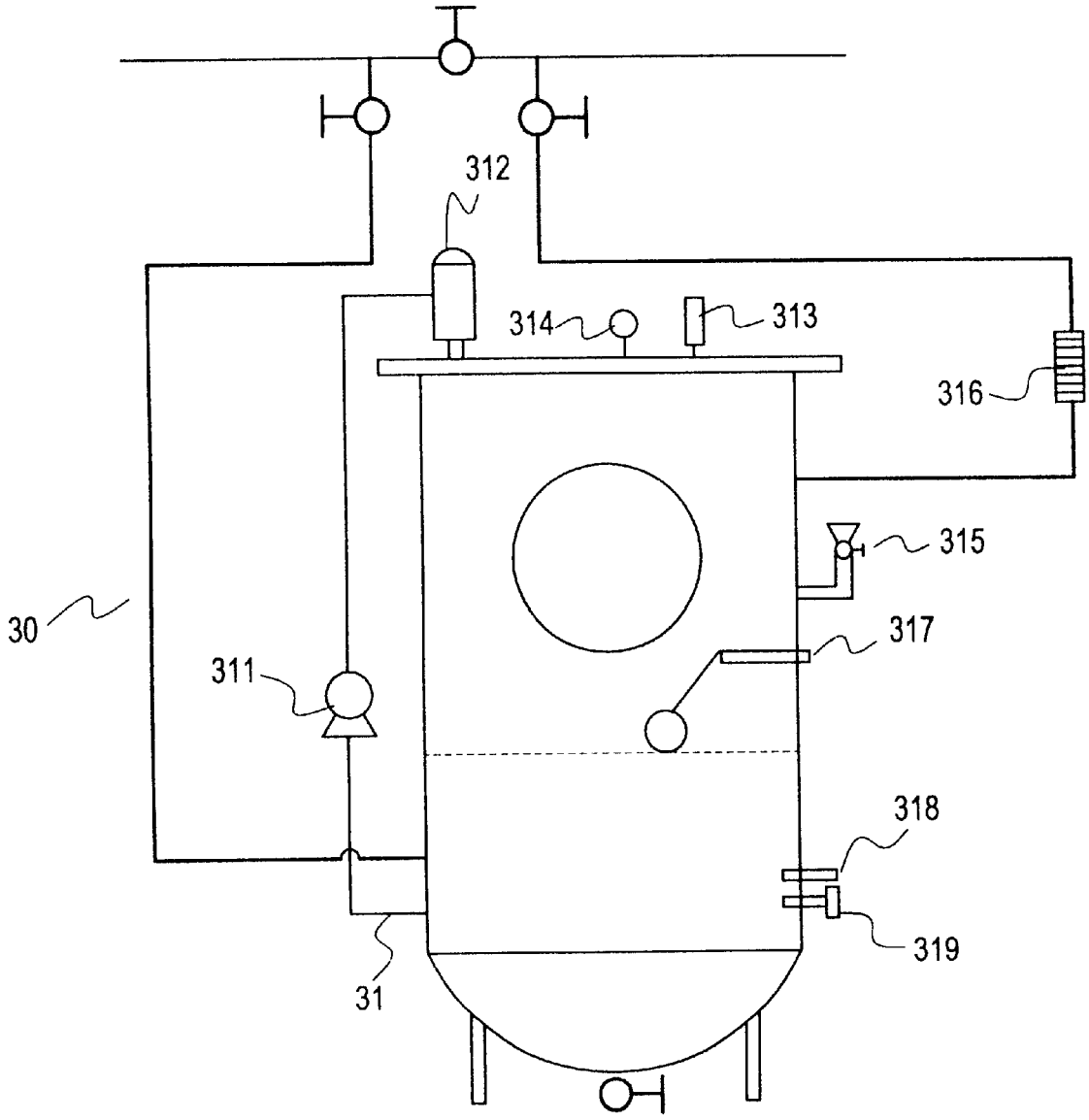
FIG. 3 is a schematic diagram of the filtering assembly in the waste breakdown system in FIG. 1.

With reference to FIGS. 1 and 3, the filtering assembly (30) has a medium filtering-adjusting mechanism (31) provided among the reaction assembly (40), the furnace (231) and the burner (23), which includes a transmission pump (311), a high speed centrifugal filter (312), a pressure gauge (314), a safety relief valve (313), a flow meter (316), an inlet (315), a level indicator (317), a thermometer (318) and a viscosity sensor (319).

Figure 4:
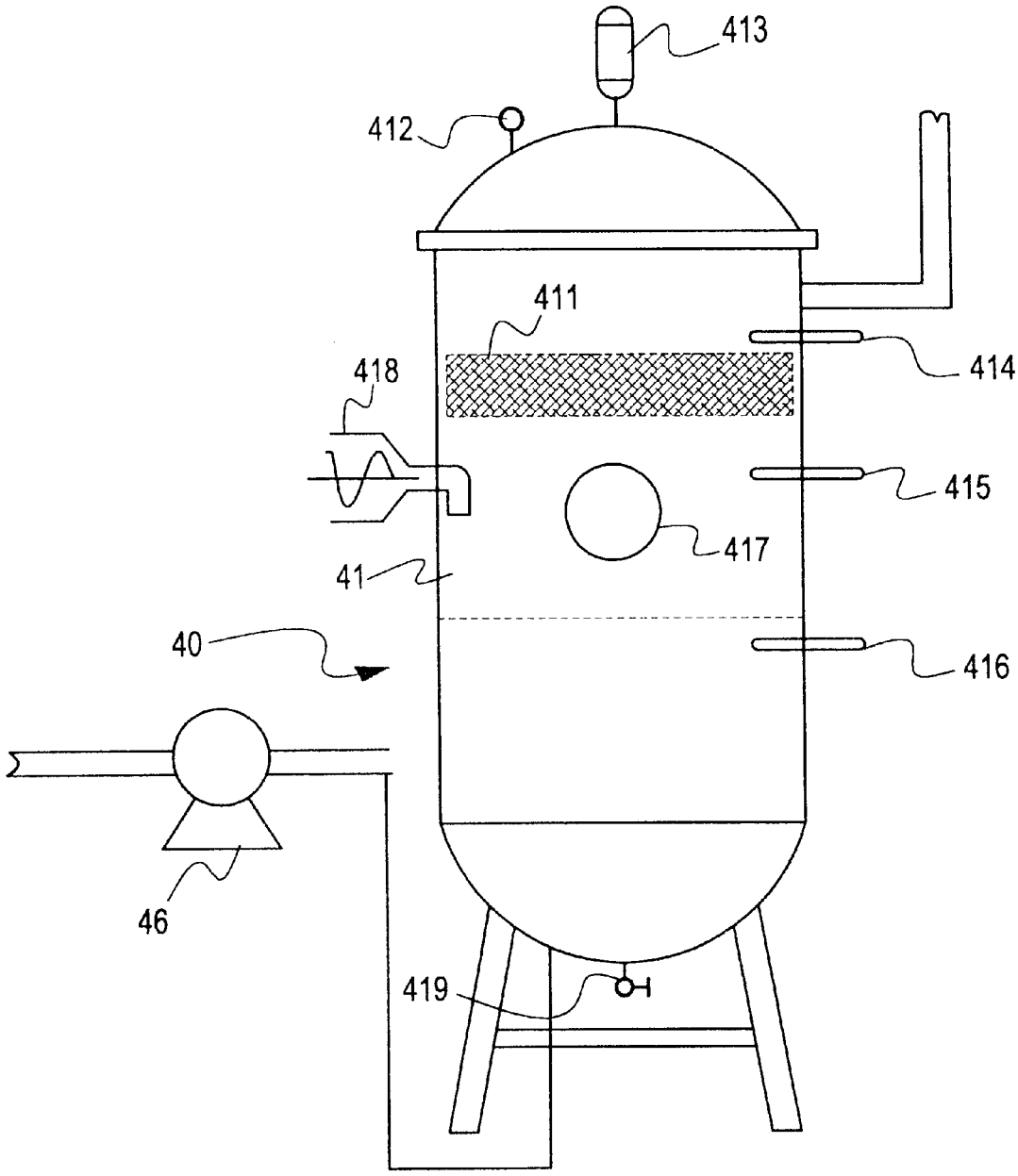
FIG. 4 is a schematic diagram of a reaction assembly in the waste breakdown system in FIG. 1.

With reference to FIG. 4, the reaction assembly (40) has a reaction chamber (41) connected respectively with the second worm (145) and a high temperature pump (46), a condenser (43) connected to the reaction chamber (41) and the gas tank (42), the first tank (44) and fuel tank (45).

The reaction chamber (41) has a filtering layer (411) able to retain long chain molecules to continue breakdown, a pressure gauge (412), a safety relief valve (413), three thermometers (414, 415, 416), a cleaning access hole (417), a dump valve (419) and an inlet (418) from the second worm (145).

With the foregoing arrangement, after the waste is ground into pieces, the conveyer (12) transports the waste to the collector (13). Then the waste is transferred to the first worm (141) for melting. The blower (21) sends hot air (around 600° C.) from the ventilation duct (143) and the hot air (around 350° C.) from the heat exchanger (22) to melt the waste on the first worm (141). When the waste is melted, liquefied waste is transported to the first tank (144) for temporary storage to eliminate air from the waste. Thereafter, the second worn (145) sends the waste to the reaction chamber (41) for breakdown.

The burner (23) generates the heat in the furnace (231), and the heat is directed to the heat exchanger (22) so the air blower (21) can blow ambient air over the heat exchanger (22) to the heater (14). The furnace (231) is also connected to the reaction chamber (41) to continuously breakdown the waste on the filtering layer (411).

The filtering-adjusting mechanism (31) provides a special medium to the reaction chamber (41) to cause the breakdown of the non-biodegradable waste. The medium has a special concentration, viscosity, and heat resistance. the high temperature pump (46) transfers the medium to the reaction chamber (41) to mix with the liquefied waste and cause the waste to be broken down at a low temperature. After the medium is mixed with the waste, the filtering-adjusting mechanism (31) is able to filter out debris in the medium to allow the medium to be recycled.

Further, after the long chain molecules are retained on the filtering layer (411) for continuous breakdown and broken into short chain molecules, the short chain molecules seep through the filtering layer (411) and into the condenser (43) to become a light oil of high quality. The light oil is then stored in the fuel tank (45). The non-condensed flammable gas is then stored in the gas tank (42).

Either the fuel tank (45) or the gas tank (42) is connected to the burner (23) to provide the fuel necessary for burning, so the system is a self-sustaining and does not harm the environment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A self-sustaining waste breakdown system having:

a preprocessing assembly which includes a grinder to grind the waste, a conveyer to convey the ground waste, a collector for receiving the ground waste and a heater to melt the ground waste;

a heating assembly for providing heat to the heater to melt the ground waste and which has a heat exchanger, a burner and a furnace;

a filtering assembly which has a medium filtering-adjusting mechanism provided between the furnace and the burner to recycle the medium, wherein the filtering-adjusting mechanism includes a transmission pump, a high speed centrifugal filter, a pressure gauge, a safety relief valve, a flow meter, an inlet, a level sensor, a thermometer and a viscosity sensor;

a reaction assembly which has a reaction chamber connected respectively with a second worm of the preprocessing assembly and a high temperature pump, the gas tank, a condenser connected to the reaction chamber, the fuel tank and the gas tank, wherein the improvements comprise:

the reaction chamber has a filtering layer to retain long chain molecules of the melted waste for continuous breakdown so as to change the long chain molecules into short chain molecules; and the filtering-adjusting mechanism is provided to recycle the medium with a special concentration, viscosity and heat resistance in the reaction chamber.

* * * * *